US007784479B2

(12) United States Patent
Navarro

(10) Patent No.: US 7,784,479 B2
(45) Date of Patent: Aug. 31, 2010

(54) ADJUSTABLE LIGHTED WALKING AID

(75) Inventor: Randal A. Navarro, 5460 Andy St., Lakewood, CA (US) 90712

(73) Assignee: Randal A. Navarro, Fountain Valley, CA (US)

( * ) Notice: Subject to any disclaimer, the term of this patent is extended or adjusted under 35 U.S.C. 154(b) by 127 days.

(21) Appl. No.: 12/335,482

(22) Filed: Dec. 15, 2008

(65) Prior Publication Data

US 2010/0147342 A1 Jun. 17, 2010

(51) Int. Cl.
*A45B 3/04* (2006.01)

(52) U.S. Cl. ..... 135/66; 135/910; 362/102

(58) Field of Classification Search ..... 135/66, 135/910; 362/102
See application file for complete search history.

(56) References Cited

U.S. PATENT DOCUMENTS

| | | | | |
|---|---|---|---|---|
| 2,173,624 | A | 7/1938 | Dyer | |
| 2,435,650 | A | 1/1946 | Greene | |
| 2,642,519 | A | 6/1949 | Caustin | |
| 3,336,469 | A * | 8/1967 | Barnes et al. | 362/102 |
| 4,013,881 | A | 3/1977 | Sargent | |
| 4,062,371 | A * | 12/1977 | Bolen | 135/66 |
| 4,064,429 | A | 12/1977 | Boehm | |
| 4,236,544 | A | 12/1980 | Osaka | |
| 4,562,850 | A | 1/1986 | Earley | |
| 4,625,742 | A | 12/1986 | Phillips | |
| 5,197,501 | A | 3/1993 | Ragatz | |
| 5,219,402 | A * | 6/1993 | Kondo et al. | 135/66 |
| 5,331,990 | A | 7/1994 | Hall | |
| 5,351,704 | A * | 10/1994 | Hunnicutt et al. | 135/66 |
| 5,588,735 | A * | 12/1996 | Harada | 362/102 |
| 5,722,445 | A * | 3/1998 | Hae et al. | 135/65 |
| 5,810,466 | A | 9/1998 | Young | |
| D408,126 | S | 4/1999 | Hunnicutt, Jr. | |
| 6,145,993 | A | 11/2000 | Filippino | |
| 6,346,780 | B1 | 2/2002 | Parra | |
| 6,394,116 | B1 | 5/2002 | Winn | |
| 6,463,947 | B1 | 10/2002 | Wipperfurth | |
| 6,508,580 | B2 | 1/2003 | Collins | |
| 2004/0264172 | A1 | 12/2004 | Roberts | |
| 2007/0000531 | A1 * | 1/2007 | Russo | 135/66 |
| 2008/0072940 | A1 * | 3/2008 | Cheng et al. | 135/66 |
| 2009/0056777 | A1 * | 3/2009 | Lawhead | 135/66 |

* cited by examiner

*Primary Examiner*—David Dunn
*Assistant Examiner*—Noah Chandler Hawk
(74) *Attorney, Agent, or Firm*—Bernard L. Kleinke; Duckor Spradling Metzger & Wynne

(57) ABSTRACT

An adjustable lighted walking aid adapted to be used in low light or dark areas is disclosed and may include a cane having a front light for illuminating obstacles being encountered in front of the user and a back light for simultaneously illuminating the area proximate the feet of the user so that the user may see and thus help avoid upcoming obstacles in front, as well as observe the area at his or her feet while walking. The cane may be used in its generally vertical manner during use to assist properly the stability of the user, and is adjustable in its length to accommodate a variety of users.

17 Claims, 3 Drawing Sheets

ADJUSTABLE LIGHTED WALKING AID

BACKGROUND OF THE INVENTION

1. Field of the Invention

The present invention relates in general to lighted walking aids. It more particularly relates to an adjustable offset cane which may provide illumination of the walkway for the user.

2. Background Art

There is no admission that the background art disclosed in this section legally constitutes prior art.

Typically, people who need to use a walking aid such as a cane, crutches or a walker, are more likely to trip over obstacles and fall due to their difficulty with walking when attempting to walk in dimly lit or dark locations. There have been a variety of walking aids equipped with lights to assist the user in viewing the obstacles and hopefully to avoid tripping and falling. For example, reference may be made to the following U.S. Pat. Nos. 4,562,850; 5,197,501; 5,810,466; and 6,463,947.

In an attempt to illuminate the path of a user, several walking aids equipped with lights have been proposed. U.S. Pat. No. 4,562,850, titled Combination Walking Cane, Path Light and Upright Device, describes a cane having a forward facing light projecting from the cane near the bottom tip of the cane. Due to its proximity to the ground, this light would only illuminate a small area around the tip of the cane. Furthermore, the location of the light near the bottom of the cane makes it more likely that the light would make contact with an object and potentially be damaged or broken. Additionally, the wiring for the light extends from the bottom of the adjustable cane to the end of its handle, so the wiring will be subject to movement every time the cane height is adjusted, which could lead to wiring failures.

U.S. Pat. No. 5,197,501, titled Multi-Purpose Cane, discloses a cane having a moveably mounted light disposed on the outside of the middle section of the cane for allowing the light to be rotated in various directions, but is, of course, limited to a single desired direction only. This cane is not shown as being adjustable in its length.

Another approach is described in U.S. Pat. No. 5,810,466, titled Walking Cane. This patent discloses a cane which includes a flashlight-sized device serving as the handle of the cane and a gas filled tube light in the leg section of the cane. Due to the angle of the handle of this cane when the cane is in its generally vertical intended support manner during use, it appears that the user may have difficulty supporting himself or herself with the cane in certain circumstances. Furthermore, as shown in FIG. 1, when the handle/light is held inclined downwardly to illuminate the path in front of the user, the shaft of the cane is inclined angularly rearwardly at an angle such that the user may not be able to support himself or herself adequately with the cane in at least some circumstances. Due to the structure of this cane with the gas filled tube light in the mid portion of its leg section, the light provided by the tube would be of little use to the user, as the tube light is raised up from the ground and located by a great distance to the rear of the user when the cane is used in the position shown in FIG. 1. Also, this cane would not be adjustable in length.

U.S. Pat. No. 6,463,947, titled Directionally Illuminating Walking Aid, discloses an offset cane having a light disposed near the tip of the cane. The light may be directionally controlled by the use of at least one vertical reflector to direct the light outwardly of the shaft of the cane in one desired direction. Light rings may be included above and/or below the vertical reflectors to allow light to radiate in all directions. The structure of this cane also does not allow it to be adjustable in length.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DESCRIPTION OF CERTAIN EMBODIMENTS OF THE INVENTION

Figure 1:
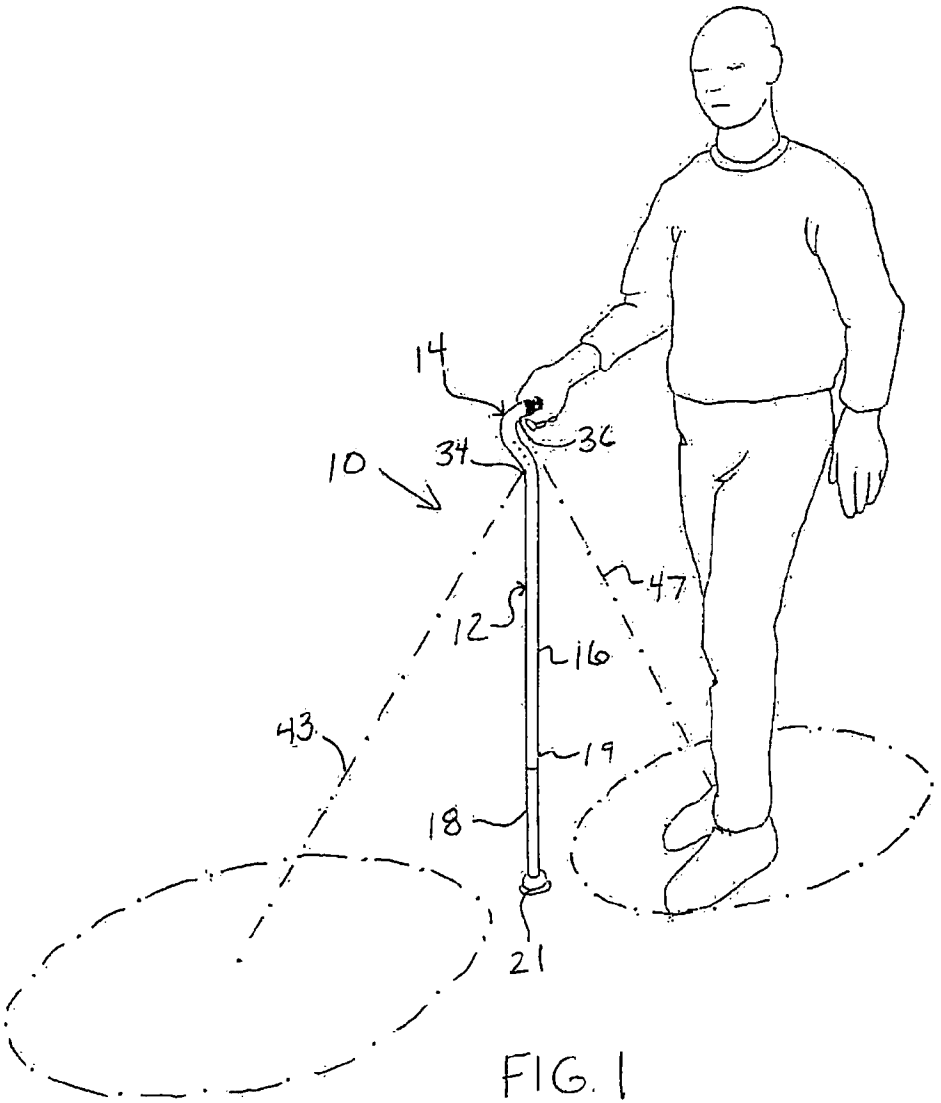
FIG. 1 is a pictorial view of an embodiment of an adjustable lighted walking aid constructed according to the present invention showing the principal axes of illumination for both the front and rear light emitting diodes (LEDs)

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

An adjustable lighted walking aid adapted to be used in low light or dark areas is disclosed and may include a cane having a front light for illuminating obstacles being encountered in front of the user and a back light for simultaneously illuminating the area proximate the feet of the user so that the user may see and thus help avoid upcoming obstacles in front, as well as observe the area at his or her feet while walking. The cane may be used in its generally vertical manner during use to assist properly the stability of the user, and is adjustable in its length to accommodate a variety of users.

According to an embodiment of the invention, the adjustable lighted walking aid may include an offset cane including a handle portion, an intermediate portion integrally connected to the handle portion, and a lower portion terminating in a tip and being telescopically connected at its upper end to the intermediate portion to allow adjustment of the height of the cane. The handle portion may include a handle being disposed substantially perpendicular to the intermediate portion, an angled portion integrally connected to the top of the intermediate portion, and a curved portion integrally connecting the handle to the angled portion. A front light emitting diode may be disposed in the angled portion at a lower section thereof and have its principal axis of illumination inclined downwardly forwardly at about a 55° angle with respect to the intermediate portion to direct light downwardly and in front of the cane A back light emitting diode may be disposed in the curved portion at a central section thereof and have its principal axis of illumination inclined downwardly rearwardly at about a 35° angle with respect to the intermediate portion to direct light downwardly and in back of the cane. The principal axis of illumination of the front light emitting diode may be substantially perpendicular to the principal axis of illumination of the back light emitting diode.

According to yet another embodiment of the invention, a plurality of warning lights such as red light emitting diodes may be disposed on at least one side of the angled portion to direct light to at least one side of the cane. An electronic controller may be disposed within the handle for controlling the light emitting diodes. A battery may be disposed within the handle for providing power to the light emitting diodes and the electronic controller. A switch may be disposed on an end of the handle and electrically connected to the electronic controller to allow operation of the light emitting diodes.

According to another aspect of an embodiment of the invention, when the inventive cane is held in a substantially upright position during use, the principal axis of illumination of the light from the front light emitting diode may be projected onto the ground a substantial distance in front of the tip of the cane to illuminate the ground in front of the user so that the user can see and be alerted to possible oncoming obstacles in his or her path of travel. The principal axis of illumination of the light from the back light emitting diode may be projected onto the ground a substantial distance in back of the tip of the cane to illuminate the ground in the proximity of the feet of the user so that the user can avoid the earlier sited obstacles now at his or her feet. Therefore, the user may simultaneously view his or her forward path of travel and the ground at his or her feet, while maintaining the cane in a generally upright manner to provide adequate support for the user. Also, the cane is adjustable in its length to accommodate different users.

According to another embodiment of the invention, the adjustable lighted walking aid may include an offset cane including a handle portion, an intermediate portion integrally connected to the handle portion, and a lower portion terminating in a tip and being telescopically connected at its upper end to the intermediate portion to allow adjustment of the height of the cane. The handle portion may include a handle being disposed substantially perpendicular to the intermediate portion, an angled portion integrally connected to the top of the intermediate portion, and a curved portion integrally connecting the handle to the angled portion. A front light emitting diode may be disposed in the angled portion at a lower section thereof and have its principal axis of illumination inclined downwardly forwardly at about a 55° angle with respect to the intermediate portion to direct light downwardly and in front of the cane. A back light emitting diode may be disposed in the curved portion at a central section thereof and have its principal axis of illumination inclined downwardly rearwardly at about a 35° angle with respect to the intermediate portion to direct light downwardly and in back of the cane. The principal axis of illumination of the front light emitting diode may be substantially perpendicular to the principal axis of illumination of the back light emitting diode. An electronic controller may be disposed within the handle for controlling the light emitting diodes. A battery may be disposed within the handle for providing power to the light emitting diodes and the electronic controller. A switch may be disposed on an end of the handle and electrically connected to the electronic controller to allow operation of the light emitting diodes. When the cane is held in a substantially upright position during use, the principal axis of illumination of the light from the front light emitting diode may be projected onto the ground a substantial distance in front of the tip of the cane to illuminate the ground in front of the user so that the user can see obstacles in his or her path of travel, and the principal axis of illumination of the light from the back light emitting diode may be projected onto the ground a substantial distance in back of the tip of the can to illuminate the ground in the proximity of the feet of the user so that the user can avoid obstacles at his or her feet. Therefore, the user may simultaneously view his or her forward path of travel and the ground at his or her feet.

In accordance with the invention, the adjustable lighted walking aid may continually provide light both in front of the user to allow him or her to view upcoming obstacles and at the area proximate the user's feet to allow him or her to avoid those obstacles while using the cane in its generally vertical intended manner.

Figure 2:
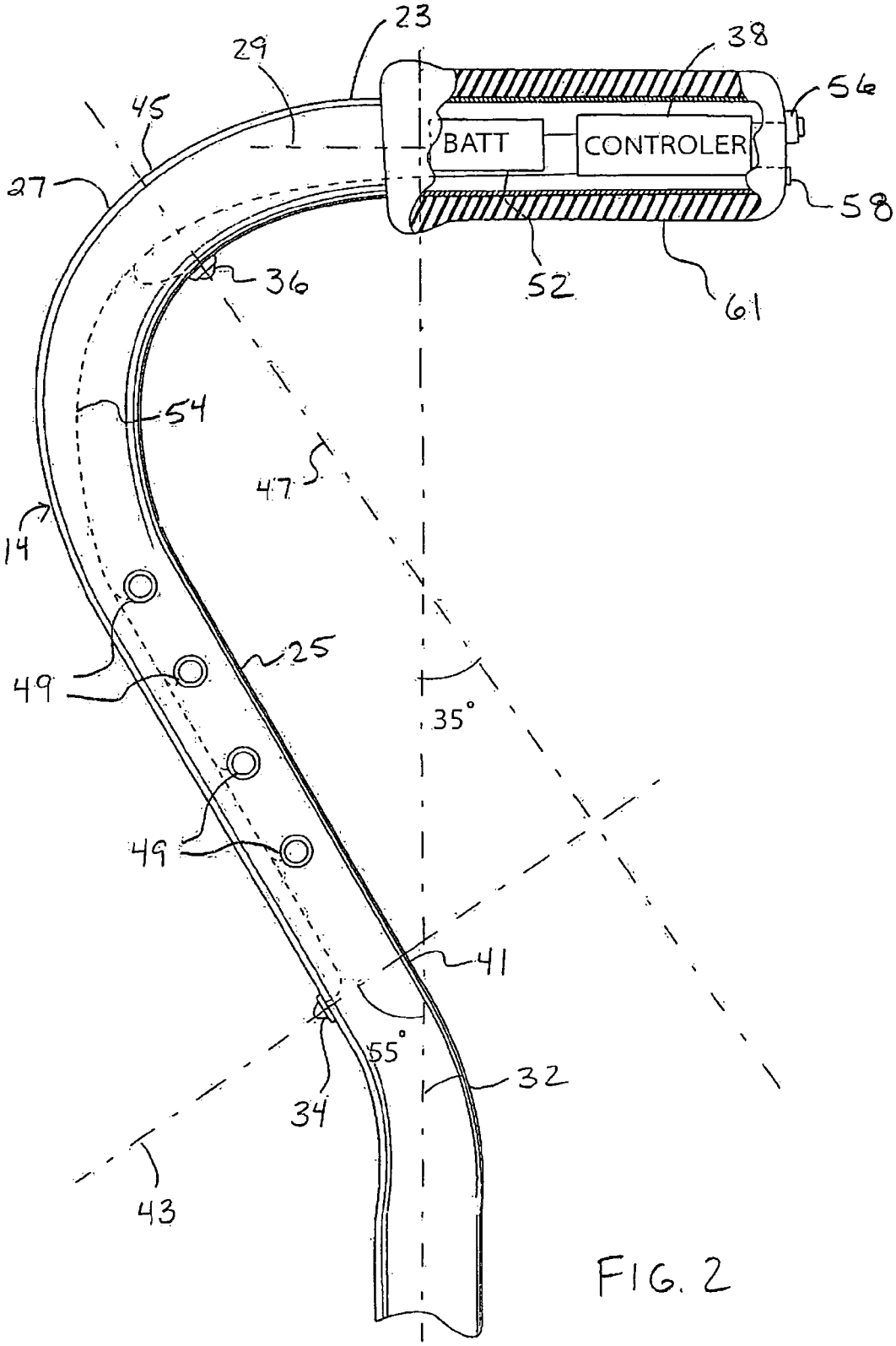
FIG. 2 is a greatly enlarged partial sectional fragmentary side view of the handle portion of the lighted walking aid illustrated in FIG. 1.
Figure 3:
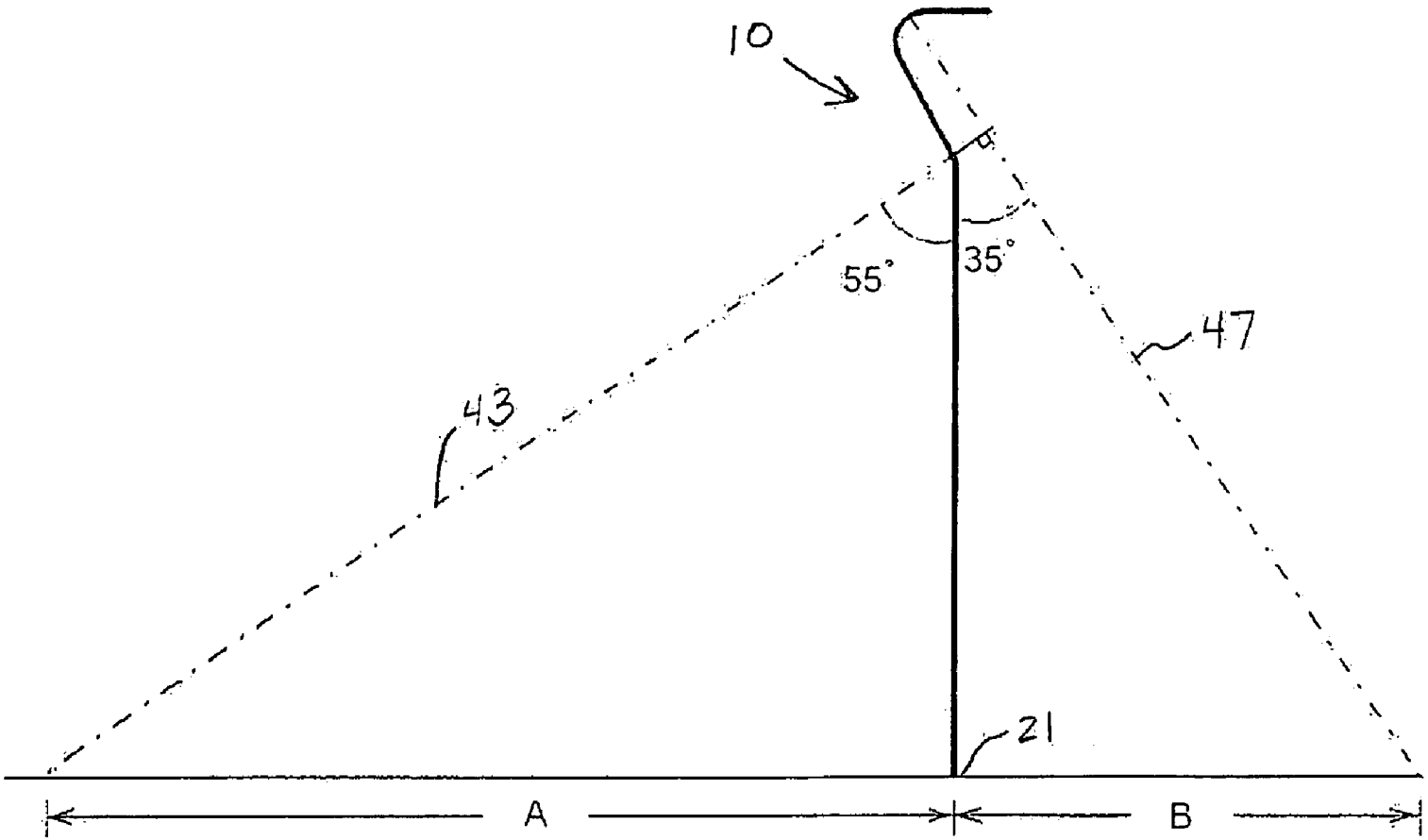
FIG. 3 is a diagrammatic view of the lighted walking aid of FIG. 1 presenting the geometric relationships of the principal axes of illumination of the front and rear LEDs.

Referring to FIGS. 1-3, an embodiment of an adjustable lighted walking aid according to the present invention is shown. The adjustable lighted walking aid 10 may include an offset cane 12 including a handle portion 14 integrally connected to an intermediate portion 16, and a lower portion 18 terminated in a tip 21 and telescopically connected to the intermediate portion 16 to allow adjustment of the height of the offset cane 12 depending on the size of the user. The intermediate portion 16 may include ten adjustment holes (not shown) spaced approximately one inch apart that are adapted to mate with a depressible button 19 to allow the height of the offset cane to be adjustable by up to nine inches from about 23.5 inches to about 32.5 inches.

The handle portion 14 of the offset cane 12 may include a handle 23, a angled portion 25 integrally connected to the top of the intermediate portion 16 of the offset cane 12, and a curved portion 27 integrally connecting the handle 23 to the angled portion 27. The central axis 29 of the handle 23 may be substantially perpendicular to the central axis 32 of the intermediate portion 16.

A lighting apparatus may be disposed only in the handle portion 14 of the offset cane 12 to avoid the complexities of locating it within the adjustable portion of the cane 12. The lighting apparatus may include a front light emitting diode (LED) 34 to direct light downwardly and in front of the cane 12, a back LED 36 to direct light downwardly and in back of the cane 12, and a controller 38 disposed in the handle 23 for controlling the operation of these LEDs. The front LED 34 may be disposed in a lower section 41 of the angled portion 25 and having a principal axis of illumination 43 inclined downwardly forwardly at about a 55° angle with respect to the central axis 32 of the intermediate portion 16. The back LED 36 may be disposed at a central section 45 of the curved portion 27 and having a principal axis of illumination 47 inclined downwardly rearwardly at about a 35° angle with respect to the central axis 32 of the intermediate portion 16.

These angles of the principal axis of illumination may be critical to provide adequate illumination at both in front of the user and at the feet of the user. In the height adjustment range of the cane 12, the distance A from the tip 21 of the cane to the principal axis of illumination 43 of the front LED 34 may range from about 2 feet to about 3 feet, and the distance B from the tip 21 of the cane 12 to the principal axis of illumination 47 of the back LED 36 may range from about 1 foot to about 1.6 feet.

A plurality of side LEDS 49 may be disposed on a side of the cane 12 to provide visibility of the cane 12 from the side. A second plurality of side LEDs (not shown) may be disposed on the opposite side of the cane 12 to provide visibility of the cane 12 from the opposite side. The side LEDs may be colored red and also be controlled by the controller 38.

A battery 52 may be disposed within the handle 23 to provide power to both the LEDs and the controller 38. Wiring 54 may provide control and power signals to the LEDs from the controller 38 and battery 49 to permit the operation of the LEDs. A switch 56 may be located on the end of the handle 23 to provide a signal to the controller 38 to select the operation of the LEDs. The switch 56 may be convenient for the user to switch ON or OFF the LEDs. The switch 56 may be a push-button switch, such that a first push turns on the LEDs and a second switch turns off the LEDs, or alternatively subsequent pushes of the switch 56 may turn on different combinations of the LEDs, such as only the front and back LEDs without turning on the side LEDs, for example.

A battery charging plug 58 may also be located on the end of the handle 23 to allow convenient recharging of the battery 52, which may be preferably a rechargeable battery. A hand grip 61 may be disposed around the handle 23 to provide a safe and comfortable area for the user to hold the cane 12.

It should be understood that when words such as "about," "approximately," "substantially" or the like are used herein, a tolerance of plus or minus 20 percent may be employed.

While particular embodiments of the present invention have been disclosed, it is to be understood that various different embodiments are possible and are contemplated within the true spirit and scope of the appended claims. There is no intention, therefore, of limitations to the exact abstract or disclosure herein presented.

What is claimed is:

1. An adjustable lighted walking aid, comprising:

an offset cane including a handle portion, an intermediate portion integrally connected to the handle portion, and a lower portion terminating in a tip and being telescopically connected at its upper end to the intermediate portion to allow adjustment of the height of the cane;

the handle portion including a handle being disposed substantially perpendicular to the intermediate portion, an angled portion integrally connected to the top of the intermediate portion, and a curved portion integrally connecting the handle to the angled portion;

a front light emitting diode being disposed in the angled portion at a lower section thereof and having its principal axis of illumination inclined downwardly forwardly at about a 55° angle with respect to the intermediate portion to direct light downwardly and in front of the cane;

a back light emitting diode being disposed in the curved portion at a central section thereof and having its principal axis of illumination inclined downwardly rearwardly at about a 35° angle with respect to the intermediate portion to direct light downwardly and in back of the cane;

wherein the principal axis of illumination of the front light emitting diode is substantially perpendicular to the principal axis of illumination of the back light emitting diode;

a plurality of warning light emitting diodes disposed on at least one side of the angled portion to direct light to at least one side of the cane;

an electronic controller disposed within the handle for controlling the light emitting diodes;

a battery disposed within the handle for providing power to the light emitting diodes and the electronic controller;

a switch disposed on an end of the handle and electrically connected to the electronic controller to allow operation of the light emitting diodes;

wherein when the cane is held in a substantially upright position during use, the principal axis of illumination of the light from the front light emitting diode is projected onto the ground a substantial distance in front of the tip of the cane to illuminate the ground in front of the user so that the user can see obstacles in his or her path of travel; and wherein when the cane is held in a substantially upright position during use, the principal axis of illumination of the light from the back light emitting diode is projected onto the ground a substantial distance in back of the tip of the cane to illuminate the ground in the proximity of the feet of the user so that the user can avoid obstacles at his or her feet, whereby the user may simultaneously view his or her forward path of travel and the ground at his or her feet while using the cane in its intended manner.

2. The adjustable lighted walking aid of claim 1, wherein the battery is a rechargeable battery.

3. The adjustable lighted walking aid of claim 2, further including a battery charging plug for charging the rechargeable battery.

4. The adjustable lighted walking aid of claim 1, wherein the offset cane is manufactured of aluminum.

5. The adjustable lighted walking aid of claim 1, wherein the plurality of red light emitting diodes includes at least four red light emitting diodes.

6. The adjustable lighted walking aid of claim 1, further comprising a grip disposed over handle to provide a comfortable and safe handling area for the user.

7. The adjustable lighted walking aid of claim 1, wherein height of the cane can be adjusted between about 23.5 inches to about 32.5 inches.

8. The adjustable lighted walking aid of claim 1, wherein the distance of the principal axis of illumination of the front light emitting diode projected of the ground from the tip of the cane is between about 2 feet to about 3 feet.

9. The adjustable lighted walking aid of claim 1, wherein the distance of the principal axis of illumination of the back light emitting diode projected on the ground from the tip of the cane is between about 1 foot to about 1.6 feet.

10. An adjustable lighted walking aid, comprising:

an offset cane including a handle portion, an intermediate portion integrally connected to the handle portion, and a lower portion terminating in a tip and being telescopically connected at its upper end to the intermediate portion to allow adjustment of the height of the cane;

the handle portion including a handle being disposed substantially perpendicular to the intermediate portion, an angled portion integrally connected to the top of the intermediate portion, and a curved portion integrally connecting the handle to the angled portion;

a front light emitting diode being disposed in the angled portion at a lower section thereof and having its principal axis of illumination inclined downwardly forwardly at about a 55° angle with respect to the intermediate portion to direct light downwardly and in front of the cane;

a back light emitting diode being disposed in the curved portion at a central section thereof and having its principal axis of illumination inclined downwardly rearwardly at about a 35° angle with respect to the intermediate portion to direct light downwardly and in back of the cane;

wherein the principal axis of illumination of the front light emitting diode is substantially perpendicular to the principal axis of illumination of the back light emitting diode;

an electronic controller disposed within the handle for controlling the light emitting diodes;

a battery disposed within the handle for providing power to the light emitting diodes and the electronic controller;

a switch disposed on an end of the handle and electrically connected to the electronic controller to allow operation of the light emitting diodes;

wherein when the cane is held in a substantially upright position during use, the principal axis of illumination of the light from the front light emitting diode is projected onto the ground a substantial distance in front of the tip of the cane to illuminate the ground in front of the user so that the user can see obstacles in his or her path of travel; and wherein when the cane is held in a substantially upright position during use, the principal axis of illumination of the light from the back light emitting diode is projected onto the ground a substantial distance in back of the tip of the cane to illuminate the ground in the proximity of the feet of the user so that the user can avoid obstacles at his or her feet, whereby the user may simultaneously view his or her forward path of travel and the ground at his or her feet while using the cane in its intended manner.

11. The adjustable lighted walking aid of claim 10, wherein the battery is a rechargeable battery.

12. The adjustable lighted walking aid of claim 11, further including a battery charging plug for charging the rechargeable battery.

13. The adjustable lighted walking aid of claim 10, wherein the offset cane is manufactured of aluminum.

14. The adjustable lighted walking aid of claim 10, further comprising a grip disposed over handle to provide a comfortable and safe handling area for the user.

15. The adjustable lighted walking aid of claim 10, wherein height of the cane can be adjusted between about 23.5 inches to about 32.5 inches.

16. The adjustable lighted walking aid of claim 10, wherein the distance of the principal axis of illumination of the front light emitting diode projected of the ground from the tip of the cane is between about 2 feet to about 3 feet.

17. The adjustable lighted walking aid of claim 10, wherein the distance of the principal axis of illumination of the back light emitting diode projected on the ground from the tip of the cane is between about 1 foot to about 1.6 feet.

* * * * *